US007547022B2

(12) United States Patent
Broadbent

(10) Patent No.: US 7,547,022 B2
(45) Date of Patent: Jun. 16, 2009

(54) MEANS ENABLING THE FULL LENGTH OF A FIGURE SKATE TO BE SHARPENED

(76) Inventor: Sidney Broadbent, 5265 W. Quarles Dr., Littleton, CO (US) 80128

( * ) Notice: Subject to any disclaimer, the term of this patent is extended or adjusted under 35 U.S.C. 154(b) by 0 days.

(21) Appl. No.: 11/650,179

(22) Filed: Jan. 5, 2007

(65) Prior Publication Data

US 2007/0164520 A1 Jul. 19, 2007

Related U.S. Application Data

(60) Provisional application No. 60/758,067, filed on Jan. 10, 2006.

(51) Int. Cl.
*A63C 1/00* (2006.01)

(52) U.S. Cl. ..... 280/11.18; 280/11.12; 280/809

(58) Field of Classification Search ..... 280/11.12, 280/11.18, 809

See application file for complete search history.

(56) References Cited

U.S. PATENT DOCUMENTS 2,150,964 A * 3/1939 Dornseif ..... 280/11.18

(Continued)

FOREIGN PATENT DOCUMENTS

DE 423784 2/1926

(Continued)

OTHER PUBLICATIONS

Abstracts from the USOC Sports Equipment and Technology Committee Conference Dec. 1988. USOTC Complex Section 6 p. 16,14,22 &Cover.

Final Report USOC Research Project T89/92 -021-A-FS. Figure Skate Development Jan. 4, 1994 by Sidney Broadbent Project Director pp. 11, and 22.

(Continued)

*Primary Examiner*—Paul N. Dickson
*Assistant Examiner*—Katy Meyer

(57) ABSTRACT

Skate and blade assemblies (31) include a mechanism for the removal of the drag tooth (46) to facilitate replication, during sharpening, of the skating surface's (36) rocker profile throughout its entire length. With primary emphasis in avoiding not only the inevitable progressive degradation of the frontal portion of the skating surface but actual profile mutilation because of the projecting drag tooth. Such mutilation commonplace with large diameter grinding wheel types of sharpeners adversely affects a skater's performance, ruining a career opportunity and inevitably an expensive pair of figure skates. The primary component of the mechanism is an attachable-detachable toe-pick element (33) preferably including all or most teeth required of the toe-pick including the drag tooth. Exacting docking provisions (40-44) are provided for the toe-pick element (33) with the skate structure (32) or blade (62). A preferred embodiment adopts a bolted method of fastening wherein a bolt member (34) assembles through a hole (56) in the skate structure (32) engages a threaded cam locking member (35) the cam portion (50) of which engages hole (54) in a flange (55) portion of the toe-pick element (33). Fastening involves the normal threading of the bolt (34) into the cam locking member (35). A final torqueing of this element, for which its hexagon head (52) is provided, effects a camming action of the cam (50) within the hole (54). This forcefully engages docking faces (43) with (41) and (44) with (42) for absolute precise re-docking accuracy and at the same time a locking provision of the fastener means. Assembly and disassembly involves no more than 12 seconds. A slightly smaller toe-pick element can be substituted to double the life of the blade. Hockey skates are adaptable to figure.

13 Claims, 8 Drawing Sheets

U.S. PATENT DOCUMENTS

| | | | | |
|---|---|---|---|---|
| 3,947,050 | A | 3/1976 | Isely | |
| 4,196,915 | A * | 4/1980 | Cerny | 280/11.18 |
| 6,234,532 | B1 | 5/2001 | Kollen | |

FOREIGN PATENT DOCUMENTS

| | | |
|---|---|---|
| DE | 724419 | 8/1946 |

OTHER PUBLICATIONS

Skateology Manual. Published by Iceskate Conditioning Equipment Co. Author Sidney Broadbent 1985-2006, Appendix & p. 1.1 & 1.4.
American Skating World May 1990 p. 16.
Blade Wellness Gage Information Sheet Published by Iceskate Conditioning Equipment Co.

* cited by examiner

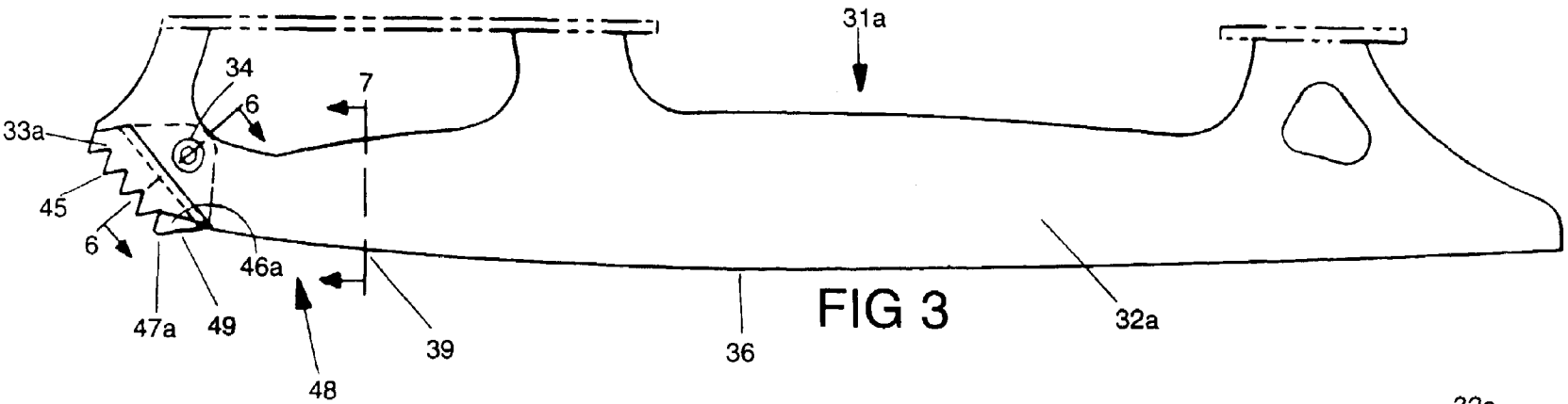
FIG 3
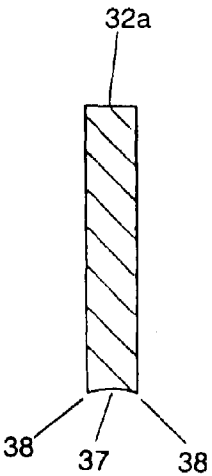
FIG 7
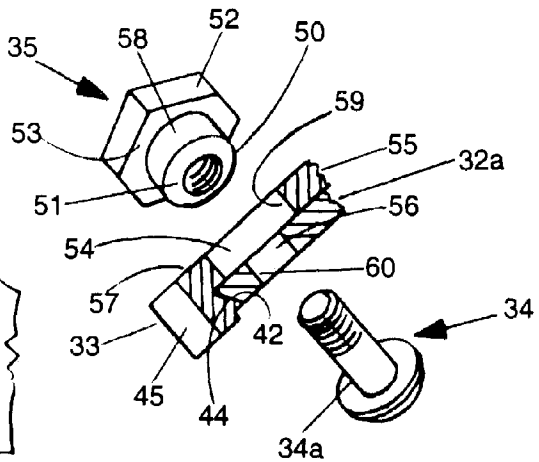
FIG 6
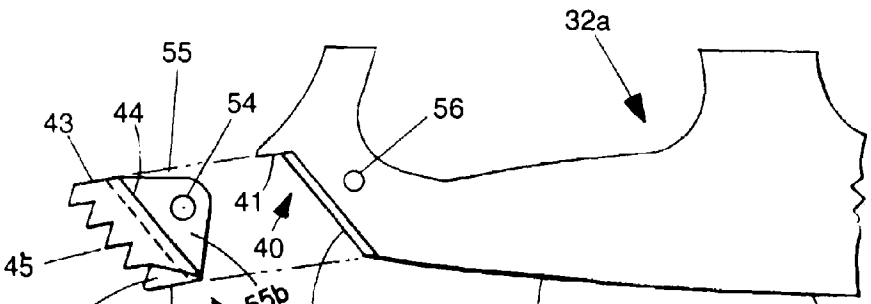
FIG 5
FIG 4

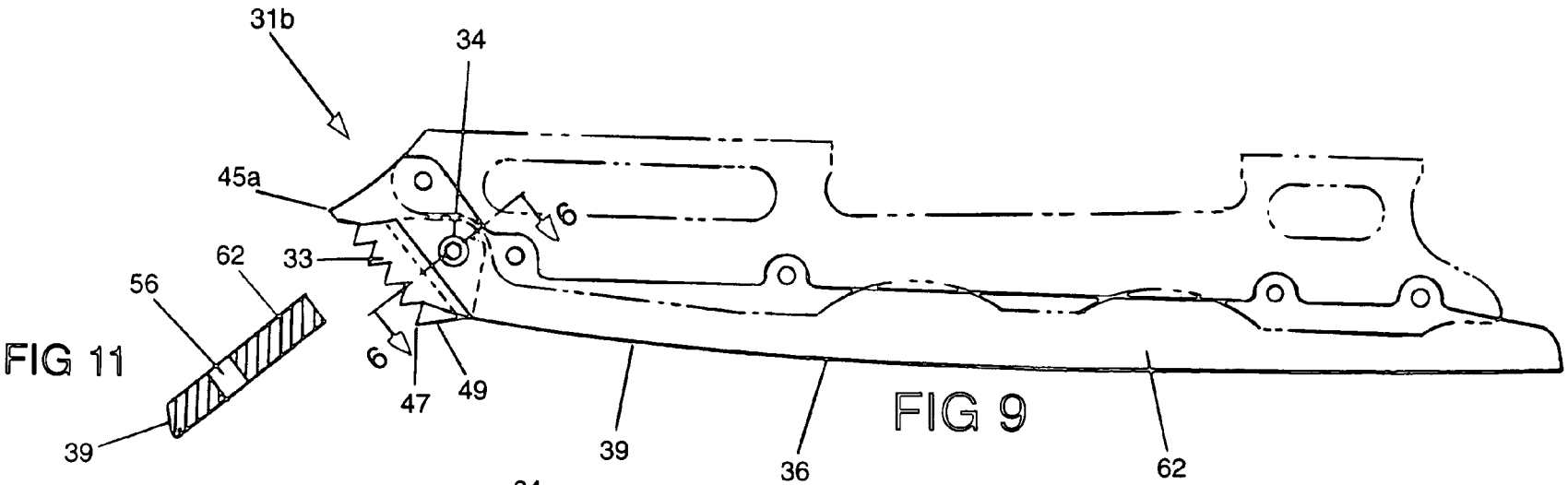
FIG 9
FIG 11
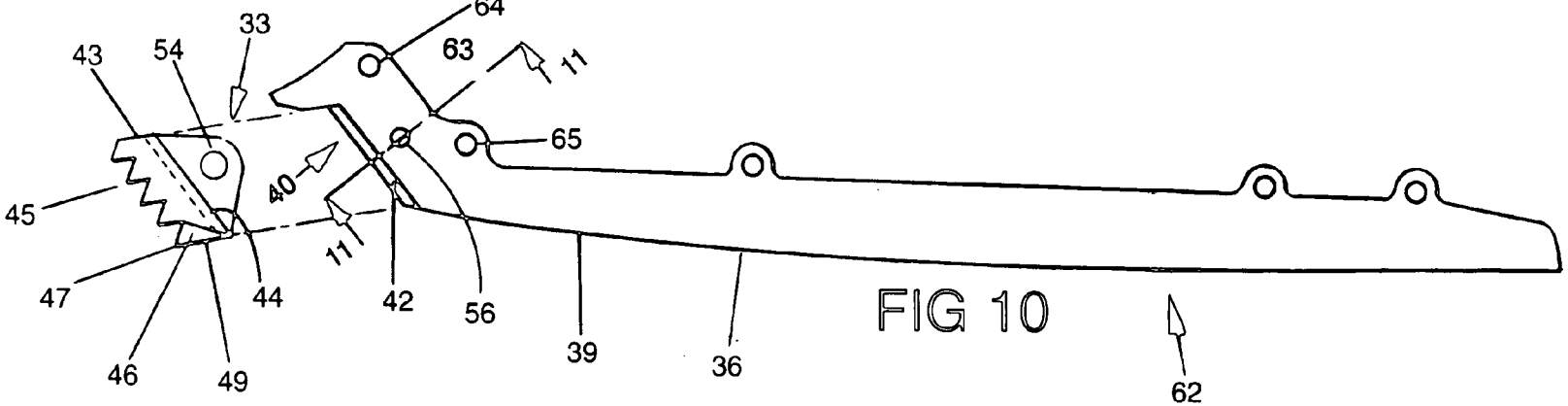
FIG 10

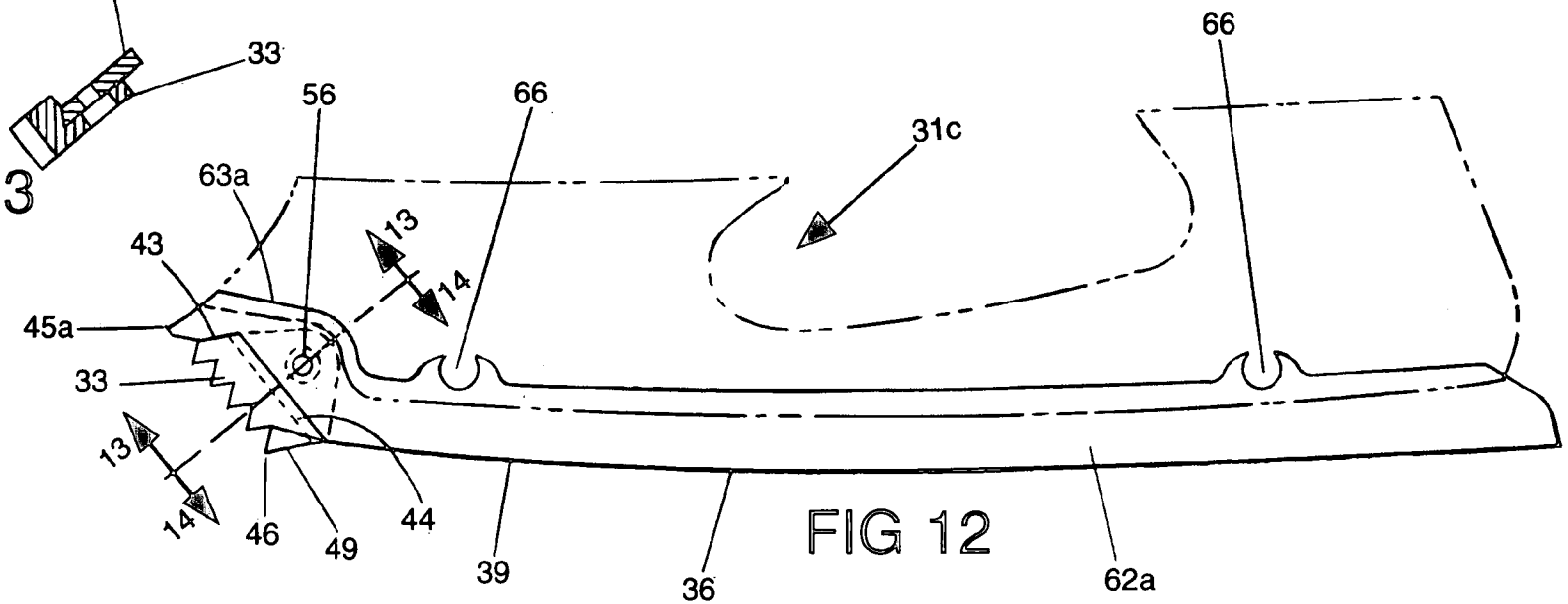
FIG 12
FIG 13
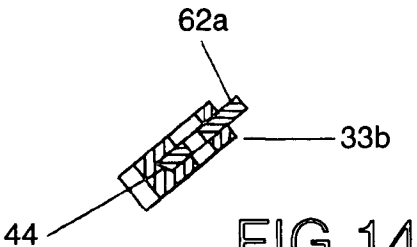
FIG 14

MEANS ENABLING THE FULL LENGTH OF A FIGURE SKATE TO BE SHARPENED

CROSS REFERENCE TO RELATED APPLICATIONS

This application claims the benefit of provisional patent application Ser. No. 60/758,067, filed Jan. 10, 2006 by the present inventor.

FEDERALLY SPONSORED RESEARCH

Not applicable

SEQUENCE LISTING OR PROGRAM

Not Applicable

BACKGROUND OF THE INVENTION

1. Field of Invention

This invention relates to ice skates, more specifically to the juxtaposition of toe-picks and skating surfaces incorporated into figure skates, and to sharpening enhancement.

2. Prior Art

The most pertinent prior art is the applicant's own research through the years 1988-92 for the Sports Equipment and Technology Committee (SETC) of the US Olympic Committee (USOC) in that time period. This has been covered by two technical reports published or available from that organization, citations A & B, the applicant's privately published Skateology Manual, citation C and a skating trade newspaper, citation D, as given on the accompanying Information Disclosure Statement. The intent of this sub-committee of the USOC was to aid the sports equipment manufacturers in many different sports including Figure Skating with outside engineering and scientific specialists.

Before the prior art ramifications of these documents can be reviewed, basic characteristics of skate technology require, terminology, definition or explanation including a blade characteristic vital to the technical presentation and comprehension of this application, namely: the 'Non Skateable Zone' (NSZ). For the latter, a single sheet document, citation E, is referenced as the most precise instrument for doing this. At the same time it introduces a unique gage for use by skate sharpeners, skating coaches and skaters for assessing the performance degradation caused by the sharpenings that blades regularly require. It does this by measuring the concomitant lengthening of this NSZ with indexes defining levels of degradation. This feature constitutes an unique paradigm for technical explanation in this application. Citation E, identifying this gage as the Blade Wellness Gage (BWG), will be referred to as the 'BWG info. sheet'. It is to be noted that in the two USOC reports, the applicant used the term Un-Skateable Zone (USZ) however the more recent usage of NSZ as disseminated in the applicant's Skateology Manual, page VII:14, will be used in the following text.

Almost all Figure skate structures have a permanently incorporated blade component that extends at least the full length of the foot having a lower peripheral surface to engage the ice in customary manner. Mounting provisions allow for attachment to a skating boot. A low cost version incorporates the blade into a molded extension of the boot structure. Others incorporate the blade either permanently or replaceable in an aluminum structure similar to a hockey skate but regardless of structure all figure skates have integral toe-picks at the front embodying several teeth. The design illustrated on page 23 of referenced Skateology Manual with brazed on sole and heel plates will be referred to as traditional.

The peripheral surface, in future termed the skating-surface, is rocketed meaning that it is provided with a longitudinally convex profile, termed the rocker that limits the extent of engagement between blade and the ice surface to a small lengthwise segment of the blade profile. This facilitates the classic maneuverability typical of figure skating. Regardless of the differences in skate structure as mentioned above, a ubiquitous feature is the frontal toe-pick with its protruding lowest tooth from which the rockered skating surface extends rearward. Such a lower tooth is termed a drag tooth, a definition to be applied throughout this specification and claims.

The rocker profile crests at approximately mid-length of the blade but the location of the balance point along the length of the blade will vary according to the skating mode being employed and the particular stance that the skater wishes to adopt during that skating mode. The exact curvature of this profile is extremely important to skating performance and the skate manufacturer uses precision profiling methods to ensure accuracy of their product as it leaves the factory. This 'new' profile is considered ideal in facilitation a figure skate's performance including numerous types of jumps, spins and artistry all depending on the profile being maintained as accurately as possible. The more important forward portion of the profile is a non-circular arc with the remainder of the length nominally circular.

Another geometrical feature equally essential to the mechanism of skating is the provision of sharp corners along the entire length of this rockered skating-surface. These have acquired the term 'edges'. The keenness of these edges is very critical and inevitable become blunted with use, attributed to the abrasive effect of a solid particle content in the ice. Consequently, re-sharpening becomes necessary from time to time and since the blade is manufactured from hardened steel a grinding operation is resorted to. Additionally, to enhance sharpness of these edges as measured by the 'bite angle' term explained on page 1:1 and 1:4 of referenced Skateology Manual, a longitudinal groove of circular cross section is provided in the skating surface. This involves removing metal from the entire width of the skating surface merely to establish a preferred sharpness and essential keenness at the extreme edge. The useful life of a blade is therefore contingent upon the amount of blade that can be removed by sharpening without significantly affecting its functional capability. The necessary blade hardness for satisfactory edge sharpness and keenness will never be a factor in this consideration since any quality blade, regardless of manufacturer, will have adequate hardness depth. It is the incremental change of rocker profile, a progressive flattening with each sharpening degrading blade performance, that is the usual blade life-determining feature. A more climactic reason and quite frequent is when flattening degenerates into concaving in the NSZ. This is shown, to scale, in an actual high level skater's blade in the referenced information sheet introducing the applicant's Blade Wellness Gauge, henceforth referred to as the BWG info sheet. The reason for this is twofold:

1. Virtually all sharpening of figure blades is accomplished using grinding wheels rotating in the plane of the blade, the primary reason being that it is a simple operation to profile the periphery of the wheel to the required radius of the groove needed in the skating surface of the blade. This groove is a variable dependent on the weight of the skater, the thickness of the blade and the temperature/hardness of the ice about to be skated on. Additionally this mode of grinding provides a superior surface finish that in turn improves the quality of the skating edge, enhancing flow of the blade on the ice and control of skating maneuvers. Unfortunately, in conjunction with reason 2 below, the wheel can only commence or finish its cut some distance rearward of the drag tooth leaving the very frontal portion of the rocker profile unsharpened, see FIG. 24.

2. The lowest tooth of the toe-pick, termed the drag tooth is the culprit preventing access of the grinding wheel to the frontal portion of the rocker profile; specifically its protrusion from the rocker profile, see FIG. 24. It also adds difficulty to the sharpening process: sharpeners normally start their sharpening pass at the front of the blade as close as practical to the drag tooth are obliged to adopt a tricky 'touch and go' routine. Depending on the ease of traversing of the skate carriage on any particular sharpening machine, this leads to a nudging in of the blade on to the wheel often too forcefully actually corrupting the blade's profile, starting with a localized concavity that progressively envelopes the forward part of the blade. This prematurely wrecks the blade for serious skating.

While the above reasons are the causes of the limited life expectancy of a figure blade, a parameter previously identified, the "Non-Skateable-Zone" (NSZ), is becoming the measure of blade life expectancy for the serious minded technicians, skaters and coaches in the sport. It is a measure of that portion of the blade immediately rearward of the toe-pick that cannot be skated on, skating being understood as the gliding of the skater normally with one edge only of the blade engaging the ice on an arcuate path. This is because the skater, to achieve equilibrium, must 'lean-into-the-circle' to counterbalance centrifugal force. The zone is nevertheless critical to jumping and spinning.

The extent of the NSZ is defined as the length from the drag tooth's tip to where a straight edge, when placed against that tip and against the rocker profile becomes tangent to that profile as shown in FIG. 1 of the BWG info sheet. The rearward limit of this zone coincides with the skater's balance point on the rocker profile when the tip of the drag tooth is aligning with the ice. It encompasses the combined surfaces of the drag tooth and the skating surface subtending a prescribed NSZ length. FIG. 2 of the BWG info sheet demonstrates how prior art has led to the type of sharpenings that can devastate a skater's performance and wreck a competitive skater's career: Another reason for introducing this reference is that it amplifies a further critical shortcoming of prior art, the very limited life of a figure skate as compared to the toe-pick less hockey blade. The Blade Wellness Gauge illustrated puts the concept of the NSZ to practical use in assessing this limited lifespan during which the critical rocker contour within the lengthening NSZ is being degraded. The gage measure this lengthening with index marks indicating the life expectancy of the blade appropriately color coded green and red respectively. Its usage here verifies the seriousness this application addresses.

Reference is now made to the two indexes labeled "NEW" and "DEGRADING". The span between these two indexes, printed in green on the actual gauge, is indicative of an acceptable life span. For the NSZ to increase from the one to the other involves an average of 0.9 mm metal removal from the blade's rocker profile as a result of sharpenings. This is designated: the serviceable or viable limit of the life of a blade for a competent skater. The resulting change of geometry is illustrated in FIG. 24 of the application assuming a careful sharpener has maintained a convex profile albeit significantly flatter than the original and leaving a slight hump immediately behind the drag tooth. A less skilled and less knowledgeable sharpener may have in all likelihood commenced the concavity depicted in FIG. 2 of the BWG Info sheet. The extent of blade degradation illustrated, for any level of skating, is is appalling. All this is due to the difficulty of commencing a grinding pass with the drag tooth obstructing a free approach path of the blade relative to the grinding wheel when starting a sharpening pass. Means for avoiding this is long overdue.

The primary purpose of the toe-pick is to facilitate jumping, both on take-off into the jump and upon landing. It comprises several teeth usually aligned at an angle approximately 50° to a plane through the mounting surfaces of the skate and extends from the center front of the blade to the rockered skating surface, with the lowest tooth protruding, as preciously observed, somewhat proud of the rocker profile. In some blade designs an adjacent tooth may also protrude proud of a virtual projection of the rocker profile. It is the problems caused by fabricating these protruding teeth, usually together with the other teeth of the toe-pick, integrally with the blade, that this invention, in addition to other advantages, is designed to overcome. Basically, these integral teeth make it impossible to replicate the original, ideal, new rocker profile of the blade during sharpening, as previously described. The drag tooth is so termed because it also serves to stabilize a single foot spin known as a scratch spin.

The rocker profile in this NSZ and its length is the most critical portion of the blade becoming functional during the initial takeoff and landings of most kinds of jumps when the drag tooth together with some portion of the NSZ momentarily penetrates below the ice surface. During this brief but critical period the NSZ portion of the blade provides control. Skaters are consequently extremely sensitive to blade profile, edge keenness and the sharpness in this zone. The limits as determined by the applicant, on the allowable growth of the NSZ and concomitant loss of performance acceptable to the experienced skater are tabulated below. These values are taken from the BWG info. sheet, Citation E. For the recreational skater considerably different matrix would pertain. Such matrix of values or alternative as deriving from some other source is implicit whenever the term NSZ is used in this application. It determines acceptable extents of metal removal from the skating surface, a basic factor in this application. While emphasizing the deplorable condition of prior art it comprises an essential explanatory tool for use in this application. In regard to the dimensional aptness of the NSZ lengths used to locate the four indexes they result from the applicants 30 years of experience designing sharpening machines specifically for figure skates, research for the USOC examining elite

| NSZ Condition | Blade size Range 7¼"-8" | Blade Size Range 8¼"-9" | Blade Size Range 9¼"-10" | Blade Size range 10¼"-11" |
|---|---|---|---|---|
| New | 1.4" | 1.5" | 1.6" | 1.9" |
| Degrade Limit | 1.8" | 1.9" | 2.1" | 2.4" |

The term blade in this chart has to be interpreted as skate for the technical level of this specification skater's blades using the test data sheets of page 23 of citation A and some 60 years of actual skating experience. They are a pioneering analytical substitute for experimental verification that the aborted testing by elite skaters, using the applicant's adjustable height, attachable detachable toe-pick equipped skates would have provided. These constitute part of prior art and will be appropriately reviewed.

Furthermore, while the main problem resulting from the lengthening of the NSZ, as sharpenings proceed, is the reduced efficiency of the blade for both jumping and spinning, the powering ability of the skater is also diminishing, there being less blade length available from which to power. Powering, the means of replenishing momentum, is termed stroking in the figure skating world. During stroking the blade's edge/ice engagement location progresses along the length of the blade from the rear of the blade forward, terminating as far forward as possible without allowing the drag tooth to engage the ice. Stroking is always from an edge and a lengthened NSZ deprives the skater of some forward, more effective portion of the blade, the drag tooth tending to drag the ice much sooner during the stroking action. Unlike in normal skating, as explained earlier, part of the edge within the NSZ becomes accessible for powering due to the low angle of the blade to the ice during stroking. Allowing the toe-pick to engage the ice is termed toe-picking and considered poor, inefficient technique. It is emphasized that all the above problems and shortcomings result from the inability to freely sharpen the full length of a figure blade—due to an obstructing drag tooth. This application is concerned with means for rectifying this situation.

Review of USOC Sponsored Prior Art

Citation A. 'Research into: Skate and Boot Design and Blade Sharpening with Recommended Design Improvements'. This comprises section 6 of 'Abstracts from the SETC Conference December 1988', which was distributed to the Principal Investigators and the involved Sports Federations.

Reference is made to page 14 of this report where it is stated that: 'the Attachable-Detachable Toe-pick is being pursued as the most promising solution for insuring blade performance'. FIG. 10 on page 16 offered design concepts for industry participation and development in achieving this advancement for the sport. The cover and page 22 included illustrations of this independent toe-pick concept installed and dissembled. Unfortunately the skate industry at that time without an engineering department, nor even a draftsman on the staff, was not up-to-the challenge. Maybe extending blade life didn't seem like a sensible business strategy. Consequently, debilitating sharpenings continue to proliferate in the sport. These same designs continue to be published in the applicant's more widely distributed publication, citation C, entitled 'Skateology Manual', on the unnumbered page following Appendix A. This page also includes a photograph of an adjustable height version intended for experimental use as detailed below.

A full complement of these, adjustable height, attachable-detachable toe-pick skates were manufactured for experimental use by three elite skaters, two male, one female. These are illustrated on page 11 of referenced document titled: 'Final Report USOC Research Project T89/92-021-A-FS—Figure Skate Development, Jan. 4, 1984, Project Director Sidney Broadbent. P.Eng. Detail drawings were included on page 22. While there is no record of this document being published, industry, namely the John Wilson Skate Co. and MK Skates, the only quality manufacturers at that time and both located in the UK, were contracted to manufacture them. The important attribute of the adjustment capability for the height of the drag tooth is that, in effect, it varied the length of the NSZ. The planned testing would have provided an understanding of the extent of performance degradation versus length of the NSZ, a documented, understanding of viable blade life. Unfortunately these tests, were not conducted, the United States Figure Skating Association made the technically inept decision to withdraw funding for the test skaters at an unwarranted late date, wasting considerable supporting funds from the USOC. Consequently, eighteen years later the association's membership, which is mandatory for competitive skaters, still risk debilitating sharpenings. Such adjustment capability plays no part in the present invention.

Profile degradation in that zone was accepted as a normal result of sharpening, that it was accompanied by performance degradation was not comprehended and there was no criteria as to when a blade was finally corrupted. Coaches, mostly non technical, most often refused to get involved in the technicalities of blades and sharpening, they're the purveyors of the art and skills of the sport. Besides, there was no definitive literature on the subject, the applicants Skateology Manual still a fledgling publication. Sharpening for figure skates was largely performed on machines designed for hockey skates devoid of a toe-pick, and was typically described as a black art. Sharpeners confined their techniques behind closed doors and consequently often critiqued as a black art.

This all reveals the general unawareness of the criticality of that NSZ to skating proficiency—at that stage of the sport's development. The preservation of the rocker profile and structural integrity of the NSZ is a primary objective of the invention.

Consequently, while the concepts of page 16 are anticipatory of the present invention in that they all had a same basic intent of removing the drag tooth from the path of a grinding wheel during sharpening. There was no attempt to dimensionally control or monitor the extent of the NSZ, a basic property of the present invention. Additionally, being to an extent conceptual, a further refinement of the present invention, a locking means ensuring positional accuracy and fastener security, is lacking.

Figures in the top and middle rows have self-locking docking cavities the security of which has been deemed unsafe, friction being looked upon as unreliable. Furthermore achieving the necessary accuracy of fit between mating surfaces 8 and 9 following hardening involves skilled expensive labor and consequently a costing problem for the finished part.

The configurations of the two middle row figures add fixing means in the form of screws with toe-picks 6 docking into a non self locking geometry. Configurations of FIGS. 28 and 29, of the mentioned document, while adequate for recreational skaters lacks lateral support to resist the forces of a badly landed jump. This is overcome in FIG. 34 with bolt 33 providing a secure lateral fastening of the toe-pick to the blade however there is no feature to forcibly wedge the V tongue of the toe-pick into the V docking slot in the blade. Appropriate for the conceptual nature of these figures a simple bolt and nut fastening is never adequate for this kind of situation where ostensibly closely mating components are subjected to forces from all directions, upward, downward, inward and sideways. Furthermore the holes in toe-pick and blade to accommodate the bolt must be oversize to allow for positional tolerances during manufacture and bolt diameter tolerances. "Clearances" will therefore exist where seemingly a secure fastening has been designed. Intimate engagement of the V tongue into the V docking slot requires an actual locking force, which is lacking. The continuous abutting and sliding that will otherwise occur due to the forces of vigorous skating routines causing wear and tear, and fretting corrosion leading to the loosening of the fastening means.

The designs illustrated in the two bottom views were optional adjustable configurations for the experimentation already reported.

There has been one report of this USOC funded research to the news media. To a now defunct publication, the American Skating World, May 1990 issue, Citation D; the toe-picks depicted were the same experimental variety with height adjust-ability relative to the blade for determination of ideal drag tooth 'protrusion' as previously detailed. Tests never materialized, consequently no skaters ever wore these toe-picks, no commercialization ensued and design details never published although included in Citation B as previously reported.

Examining the Background of the Invention from the Patent Record

The three patents by Hugo Dornseif are the most pertinent: German patents 423784 issued Feb. 9, 1926 and 724419 of Aug. 26, 1942, and U.S. Pat. No. 2,150,964 of Mar. 18, 1937. None include a drag tooth. All three pertain to a period prior to the development of modern techniques achieved through the use of that very low positioned tooth termed the drag tooth the exact location of which with respect to the frontal profile of the rockered skating surface is critical to today's skating techniques. This relationship I have previously defined using the term: Non Skateable Zone (NSZ).

In regard to 423784, its toe-pick g is basically an optional device, remove it and the skate is simply for gliding. Installed, it facilitated simple jumps and pirouettes the precursor of the modern spin. Its location lengthwise on the blade is obviously adjustable, anathema to the exacting control of the NSZ for preserving skate performance with modern skate design. Its purpose was not to facilitate sharpening, because at the time of its possible use that would have been unnecessary, sharpening at that period was of the cross grinding variety. Another shortcoming would have been that upon refitting the toe-pick to the blade there was no interacting, indexing abutment to ensure positional repeatability. Nor was any fastening means for lateral security provided. Play would exist in the fit between blade a and slot i leading to loosening of screw k with tragic consequences.

Patents 724419, U.S. Pat. No. 2,150,964 as well as U.S. Pat. No. 3,947,050 reveal an alternative approach to preservation of the rocker profile. Both use a flexible hardened blade strip secured to an underlying profiled substructure the profile of which remains inviolate: it is not subject to sharpening. Upon blunting, the existing strip is replaced with a new one having sharp edges. This idea of 70 years ago eventually having commercial success for hockey skaters under the trade name "t" blade but with out the complication of a toe-pick. They both have attached toe-pick components but not with the intent of introducing detachability for the purpose of removing the drag tooth from the path of a grinding wheel during sharpening with the objective of preserving an NSZ. In neither case does the toe-pick element include a drag tooth. In U.S. Pat. No. 3,947,050 the drag tooth, item 86, is not even part of the toe-pick, forming an integral and protruding part of the detachable blade strip, item 18. The essential need for the hinged component 48 is for release of the hook 54 from the pin 52 allowing the strip type blade 18 to be released from skate body 12. It does not require to be removed from the skate structure at any time in the life of the blade. In the case of U.S. Pat. No. 2,150,964, the reason its toe-pick does not have a drag tooth, or its blade strip a NSZ is because the functional advantages of the modern very low drag tooth had not been conceived at the time of the patent. Importantly, while cap q does serve to mask the attachment site where hooked head i engages blade holder a, for that singular purpose a simple bolt would have served adequately. The complexity of the actual fastening illustrated was necessitated to achieve toe-pick positional adjust-ability—anathema to the design philosophy expressed in this application. A unique feature of this fastening, its eccentric, needs detail examination. This eccentric, integral to item r operating in slot s permits incremental adjustment of the toe-pick; the toe-pick in this case being termed the cap q. By disengaging this eccentric within slot s, that is by rotating r internal teeth in the cap q, are free to be relocated on an indexing tooth x forming part of holder a. On reengaging the eccentric in the width of slot s, screw r' is tightened. This secures the selected location of the toe-pick but actual locking is achieved by a tooth u on the underside of head of r engaging a "counter-tooth" in the side face of cap q. The fragility and method of manufacture of the sheet metal cap q has to be critiqued as inadequate to produce the more massive teeth of present day toe-picks needed for jumping, even ignoring the fact that it doesn't have a drag tooth. The soft ductile un-hardenable metal needed to produce the hollow teeth v would be plainly unsuitable for resisting the wear and tear of the modern toe-pick, which requires comparable hardness to that of the blade portion of a skate.

In U.S. Pat. No. 6,234,532 Pieter B. Kollen, May 22, 2001 side elements 30 of the overall toe-pick geometry, also termed lateral extensions and sometime termed 'second pick means' while shown as a separate item in FIG. 7 are permanently attached by brazing becoming an integral part of the blade 14. The drag tooth, part of teeth members 29 remains an impediment to precision sharpening as previously discussed with degradation of the rocker profile in the NSZ still the primary cause of premature blade failure and skater frustration. While the overall width of the three layers of toe pick would pictorially appear to offer some level of anticipatory prior art, the following extracts from claim 11, make it clear that this is not the case:

line 5, 'a first edge . . . disposed . . . adjacent to the first fore end of the skate blade'

Line 8, 'engages the ice surface with the first fore end of the skate blade'

Lines 1, 5 and 6, 'a body toe pick . . . in an assembled state . . . between the lower runner edge and the upper mounting surface'.

Objects and Advantages of the Invention (a) Providing consistent performance for a skater throughout the lifetime of his/her skates.

(b) Sharpening is simplified, the full length of the blade being accessible—no awkward maneuvering behind a projecting drag tooth to engage a blade to the grinding wheel.

(c) The rocker profile can be maintained in pristine condition during sharpening, especially important being the frontal NSZ. Subtle variances in manufacturer's profiles would likewise be maintained.

(d) Avoidance of premature degradation of the rocker profile within the NSZ, most typically the localized concaving of the original convex profile.

(e) Full realization of the normal viable life of a skate blade due to attributes of (a), (b) and (c) above. "Normal" being understood as pertaining to a traditional blade having an integral toe pick and "viable" to the sharpening extent that increases the length of the NSZ to the limit of acceptable blade performance. A financial benefit for the skater or the skater's family or sponsor.

(f) Doubling or tripling of the viable life of a skate blade by substituting toe picks incrementally shorter by the amount necessary to restore the length of the NSZ to that of a new blade or other acceptable extent, a financial benefit for the skater or the skater's family or sponsor.

(g) The skater has a consistently performing skate blade. Proficiency on the ice is accelerated.

(h) Skater has the selection of different designs of toe pick, more specifically the design of the teeth on the toe pick with the purchase of a single pair of skates.

(i) The skater can try out the jumping and spinning characteristics of different toe pick designs without removing his/her skates.

(j) The skater can select one design of toe pick teeth for one foot and a different design for the other.

(k) When the viable life of the blade has been finally exhausted, the number of substitute toe picks considered appropriate for the particular size of blade having all been used and a new pair of skates is deemed necessary, all that need be bought is the bare skate structure. The original toe picks being "interchangeable" acquire a new life. A financial benefit.

(l) Buying toe picks is a once in a lifetime event, a long-term investment, donate-able even bequeathable.

(m) Insignificant maintenance: the toe pick is very hard, the cam nut less hard consequently any wear resulting from the camming action occurs to the cam nut, a low cost item readily available. In the riveted version, copper rivets are extremely plentiful.

(n) Achieving exact replication of toe-pick positioning with every disassembly and re-assembly as required for sharpening.

(o) Absolute security of attachment of toe-pick element to the blade or skate structure.

(p) It is applicable to the conventional hockey skate easily converting it to a figure skate.

SUMMARY OF THE INVENTION

The basic aim of the invention is the removal of the drag tooth from the skate allowing an uninterrupted grinding cut during sharpening maintaining blade performance and extending blade life. While practical designs for the removal and replacement of the drag tooth only are feasible—see FIGS. 2 and 4 of page 16 of the referenced USOC Report. This invention promotes the removal of the entire toe-pick replete with its full complement of teeth or some smaller element embodying, at least, most of the teeth. The reason for this is that a slightly smaller toe-pick or toe-pick element can then be substituted to extend blade life. The reason this becomes practical with a multi-tooth toe pick is that the extent of shortening is a function of the amount of blade removal by sharpening that extends the NSZ to its degrade limit for acceptable performance as given in the foregoing table. This amount is in the order of 0.9 mm which, at the angle that the toe pick is aligned on the blade, amounts to about 1.1 mm. Removing this amount from a single detachable drag tooth would be an unacceptably large modification affecting jumping capability. But distributed over the several teeth of a multi-tooth toe pick, tooth proportions are minimally affected leaving performance unaffected.

Obviously teeth need a support structure and for this entity the term Toe-pick Element will be used henceforth whether a full compliment of teeth is incorporated of not.

The invention in complying with the above objects and achieving the stated advantages comprises an ice skate structure fitted with a detachable-attachable toe pick element with precision indexing means registering into docking interfaces in the skate structure, the latter being termed the dock. Fastening means is augmented by a play-less locking device, one component to the other integrating the drag tooth with the forward part of the skating surface to complete the essential structure of the NSZ. For explanatory convenience this structure will henceforth be termed the NSZS.

How this whole assemblage attaches to, or forms part of a skating boot is immaterial.

To provide the essential combination of fastening security and positional repeatability numerous options are available. The invention elects to show the two very basic mechanical means, bolting and riveting. In the case of bolting the invention does not rely on a conventional bolt type fastening which typically relies on friction at interfaces, a locking provision augments the fastening ensuring that docking interfaces of the toe-pick structure and skate structure are in intimate contact when fully fastening. These docking interfaces are designed so that the combination fastening and locking provision acts in all three mutually perpendicular axes. Additionally the normal problems ensuing from hole positioning and hole and bolt diameter manufacturing tolerances, as previously mentioned: wear and tear, and fretting corrosion, is eliminated.

In one embodiment the frontal portion of the skate structure is provided with a female angular or V shaped dock having mating faces, termed interfaces, into which complementary faces on the toe-pick element engage, this taking care of requirements in two of those three axes. In most skate designs this will be in the actual blade portion of the skate structure. The third axis is accommodated by providing a flanged extension of the toe-pick element for aligned engagement with the flank of the blade. To facilitate locking these engaged and aligning faces securely, a secondary V geometry is incorporated perpendicularly to the above mentioned V shaped dock, female in the toe-pick element and male on the blade. This also provides strength in resisting lateral forces on the toe-pick.

An alternate to the above provides dual flanges to the toe-pick element for engagement with the frontal structure of the skate. In most skate designs the toe-pick element whether of the single flange of the dual flange version would engage the actual blade portion of the skate structure replete with dock. However in skates utilizing an aluminum structure, the blade which is inserted into a lengthwise groove would be manufactured devoid of toe-pick teeth leaving the aluminum structure to incorporate the docking of the toe-pick element. Alternately a forward extension of the same groove could offer the V shaped docking cavity in which case the toe-pick element should beneficially have a centralized flange, which will be more appropriately termed a tongue.

One convenient version of a combination fastening and locking mechanism comprises a cam-nut or cam-bolt eccentrically pivotal on an axis perpendicular to the plane of the blade, the camming effect of which forces the two aforementioned pairs of V mating faces into locking engagement. This camming action forcing the bolt into contact with one side of the hole it occupies eliminating the adverse effect of the unavoidable clearance, due to manufacturing tolerances, between bolt and bolt-hole.

A simple but extremely secure fastening alternative would be the use of 'soft' rivets in what would essentially be slightly misaligned holes of the toe-pick element and skate structure, the riveting action distorting and swelling the rivet into the misalignment thus locking the two components together. Nominally such holes would be considered aligned but due to manufacturing tolerances, some degree of misalignment is always present which in the case of a bolted structure involves clearances and 'play' between components. Lateral forces 'taking up the play' when it exceeds the frictional tension induced by a bolt type fastening. Such soft copper rivets are commonly used in the ice hockey business attaching skates to the hockey skating boot so the operation would be familiar to skate sharpening personnel who usually do the boot riveting work. Disassembly involves the grinding off of the rivet head and extracting the rivet shank. While this would take somewhat longer than the 8-10 seconds required of the cam-nut or cam-bolt method described above, it should be quite acceptable to sharpening personnel.

A precision figure skate sharpening taking an average of 20 minutes. An extra minute or two of the sharpener's time should be well worth the extra blade life that the invention introduces plus, of course, the improved precision of the sharpening. Additionally it would be a less expensive approach than the cam bolt/cam nut arrangement.

In this actual application where an abutment of docking faces is desired, control of the orientation of the unavoidable rivet hole misalignment can promote that requirement. The clearance designed into the hole in the attached component, namely the toe-pick element, relative to the hole in the skate structure is oriented in a direction opposed to the direction in which tension is desired. Then, with interfacing docking faces in enforced contact, riveting creates tension between those faces.

A still further option whether using the assembly convenience of interfacing docking geometrys, or not, is the use of at least two rivets in fastening and locking a toe pick element to a skate structure. The riveting negates the adverse effect of accumulated hole misalignments, due to both axial and spacing manufacturing tolerances, namely the play involved when bolts are used as the fastening method. It achieves three directional play-less security very simply. In this regard, it should be realized that the figure skater is performing many of his/hers skating drills with the tip of that drag tooth so very close to the ice. Positional accuracy of that tip is therefore crucial. Rivet hole positioning will determine positional accuracy, any accompanying docking provision would be useful in positioning the toe-pick element during riveting but not essential.

Yet another fastening option would be the use of cements or locking compounds that release using heat. This is more pertinent to incorporation of a toe-pick element into the body of the skate structure rather than onto a blade portion of that structure.

Regardless of the method used for locating, fastening and locking of toe-pick element to skate structure or to a blade, such installation joins the underside facet of the drag tooth to the skating surface thus completing the NSZS. This term, is to be understood as a distinct physical construct comprising, as explained, the underside face of the drag tooth and the forward portion of the skating surface extending rearward to where the NSZ terminates. The important improvement over prior art is that while NSZ length will continue to increase slightly with every sharpening the rocker profile of the NSZS remains intact, assuming a careful, intelligent sharpener has been entrusted with the sharpening.

Consequently when the first viable life of the blade has been used-up: that is the removal through sharpening of a prescribed extent of skating surface, the rocker profile will be 'as new' and ready for a second life with the incorporation of a slightly shorter toe-pick element as previously explained.

CONCLUSIONS, RAMIFICATIONS AND SCOPE

The basic problem underlying the effort in developing the described mechanism is exemplified in FIG. 24—rocker profile degradation or mutilation, 86 within the NSZ due to the protruding drag tooth 46. It derives from the fact that the vast majority of skate sharpeners are designed for the majority market: hockey skates. Their large size of grinding wheel 85 achieves satisfactory peripheral cutting velocity at normal motor speed at cost and mechanical simplicity advantages. For figure skates they can be devastating because they can only engage the blade some considerable distance from the drag tooth. Resulting mutilation, 86 is in the most critical zone of the skating-surface 36, the NSZ, the sharpener not even realizing his/her error and skater and coach unwittingly assuming the sharpener knows his/her business. Within the writer's knowledge numerous skaters' have had their careers or aspirations devastated. My invention is a solution to all this aggravation.

BRIEF DESCRIPTION OF DRAWINGS.

In the drawings, closely related components have the same number but different alphabetic suffixes.

FIG. 3 is a side elevation of an ice skate assembly with a full-compliment, single flanged dance style toe-pick element installed.

FIG. 4 shows the toe-pick element of FIG. 3 removed

FIG. 5 is a partial side view of the skate structure of FIG. 3

FIG. 6 is a sectional/exploded view of the cam locking mechanism for the toe-pick element.

FIG. 7 is a section through a traditional version of the skate structure of FIGS. 3 and 5.

FIG. 9 is a side elevation of a free style ice skate blade assembly incorporating a partial-compliment, single flange, toe-pick element.

FIG. 10 is a side elevation of the skate blade of FIG. 9 with toe-pick element detached.

FIG. 11 is a section through the dock section of the skate blade.

FIG. 12 shows an ice skate blade assembly adapting the toe-pick element of FIG. 9 to a hockey blade FIG. 13 is a section showing a single flanged toe-pick element positioned on the blade of FIG. 12

FIG. 14 is a section a double flanged toe-pick element substituted on the blade of FIG. 12

DRAWING REFERENCE NUMBERS

Item No Description
31 Skate Assembly
31*a* Skate Assembly
31*b* Blade Assembly
31*c* Blade Assembly
31*d* Skate Assembly
32 Skate Structure
32*a* Skate Structure
32*b* Skate Structure
33 Toe-pick Element (TPE)
33*a* Toe-pick Element
33*b* Toe-pick Element
33*c* Toe-pick Element
33*d* Toe-pick Element
33*e* Toe-pick Element

34 Bolt
34*c* Bolt
34*d* Shank Portion of Bolt
35 Cam Locking Member (CLM)
35*a* Cam Locking Member
35*b* Cam Locking Member
35*c* Cam Locking Member
35*d* Cam Locking Member
36 Skating Surface
37 Groove in Surface
38 Edges
39 Rearward Terminus of NSZS
40 Dock
41 Registration Face in Dock Upper
42 Registration Face in Dock Lower
43 TPE Index Face Upper
44 TPE Index Face Lower
45 TPE Tooth
46 TPE Drag Tooth Free Style
46*a* TPE Drag Tooth Dance
46*b* TPE Drag Tooth Replacement
47 TPE Tip of Drag Tooth F/Style
47*a* TPE Tip of Drag Tooth Dance
48 Non Skateable Zone Structure NSZS
49 Underside of Drag Tooth
50 Cam-part of CLM
51 Threaded Hole in CLM
52 Head of CLM
53 Undersurface of Head of CLM
54 Hole in Single Flange TPE
54*a* 2nd hole in Double Flanged TPE
55 Flange of Toe-pick Element
56 Hole in Skate Stucture/Blade
57 Rear Face of TPE Flange
58 Cam Face-part of CLM
58*a* Cam Face-part of CLM
58*b* Cam Face-part of CLM
59 Internal surface of Hole 54
60 Internal surface of Hole 56
61 Lock Nut for 34-34*c*
62 Blade Non Traditional FIG. Skate
62*a* Blade Non Traditional Hockey Skate
62*b* Blade Non Traditional Hockey Skate
63 Blade Modification FIG. Skate
63*a* Blade Modification Hockey Skate a
64 Hole-Blade Attachment
65 Hole-Blade Attachment
66 Fastening Recesses Hockey Blade
67 Traverse Screws Bockey Blade
68 Registration Face Upper in TPE(33*c*)
69 Registration Face Lower in TPE (33*c*)
70 Index Face Upper in Skate Struc. 32
71 Index Faces Lower in Skate Struc. 32
72 Flanges on TPE 33*b*-33*e*
73 Bottom of Slot in TPE 33
74 Slot between Flanges TPE 33*c*
75 Front Face of Blade 62*b*
76 Radius at bottom of Dock 40*a*
77 Radius on Flanges of TPE 33*c*
78 Retailing Ring

DESCRIPTION OF INVENTION

Figure 1:
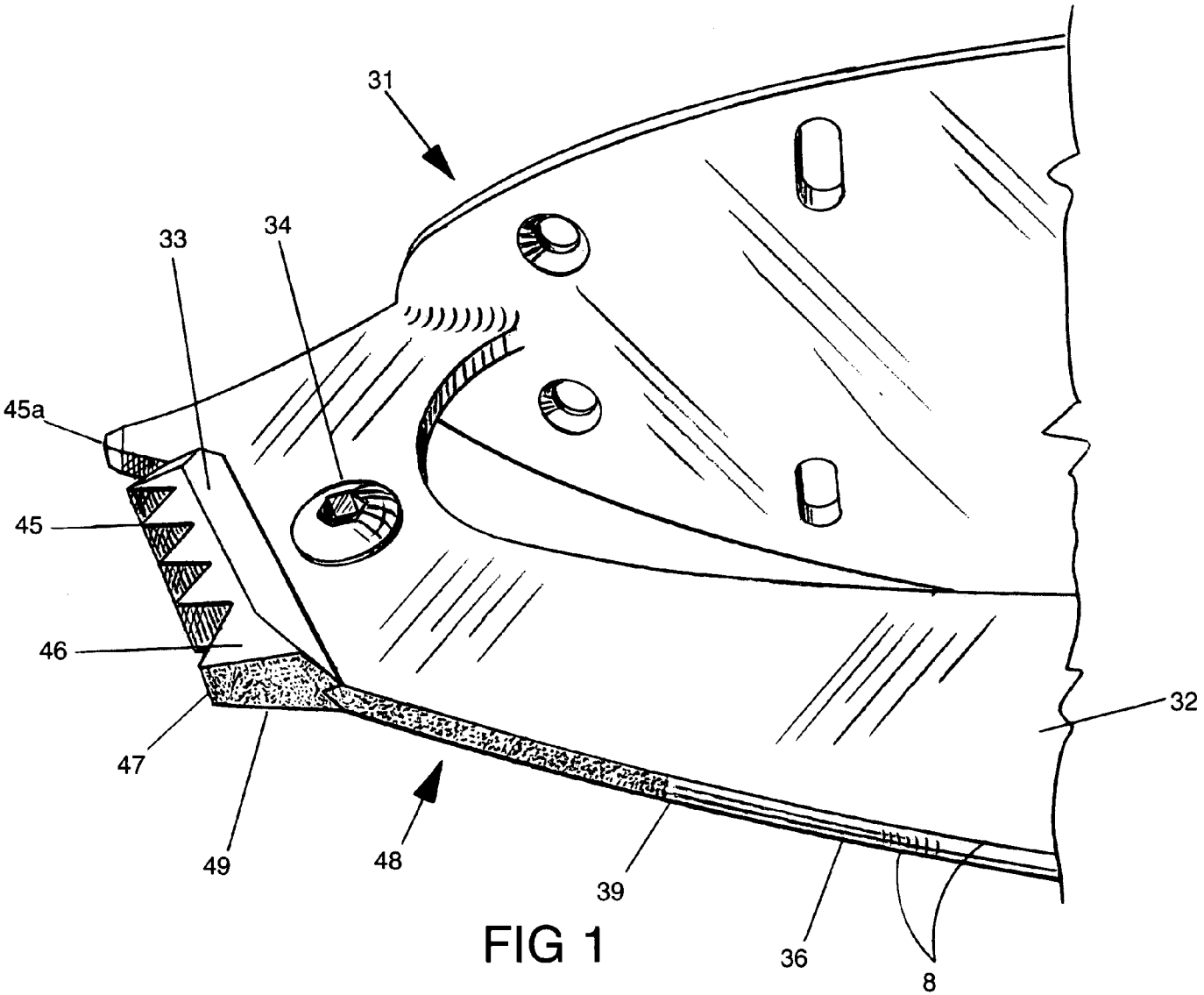
FIG. 1 is a perspective view of the type of an ice skate assembly with partial-compliment, single flanged, free style toe-pick element installed and showing the NSZS.

Defining the Non Skateable Zone Structure (NSZS) Applicable to All Embodiments The perspective view of FIG. 1 shows the invention applied to a traditional style of freestyle skate. It includes the frontal portion of an ice skate assembly 31 comprising a lengthwise structure 32, an attachable-detachable toe-pick element 33 and bolt member 34 shown installed at the at the front of this structure. In this depiction the toe-pick element 33 is of the single flange variety embodying all but one of a normal compliment of teeth 45 customary for a freestyle skate. The independent tooth 45*a* is the uppermost. It is formed intact with the structure 32. The screw 34, of which only the head is shown is a reactionary member of a camming mechanism that locks the toepick element 33 into a skate structure 32 or skate blade 62 in that the plain portion of its shank. To the skate technician, sharpener and skater it would appear as, and would be assumed to be the actual fastener. It does contribute to the fastening process in that the plain portion of its shank reacts the camming force of the cam locking member 35 against the inside surface of hole 56 but it is the camming function of the Cam Locking member 35 which is the actual fastening mechanism combining fastening and locking in three mutually perpendicular axes as will be described later in this section, an important unobvious feature of the invention.

The tip 47 of the drag tooth 46 defines the forward limit of the Non Skateable Zone (NSZ) and location 39 defines the rearward limit as previously explained. The underlying structure of this zone including the underside 49 of the drag tooth 46 and adjoining forward-most portion of the skating surface 36 comprises the Non Skateable Zone Structure (NSZS). In appropriate Figs. The NSZS is identified in dot shading.

Figure 2:
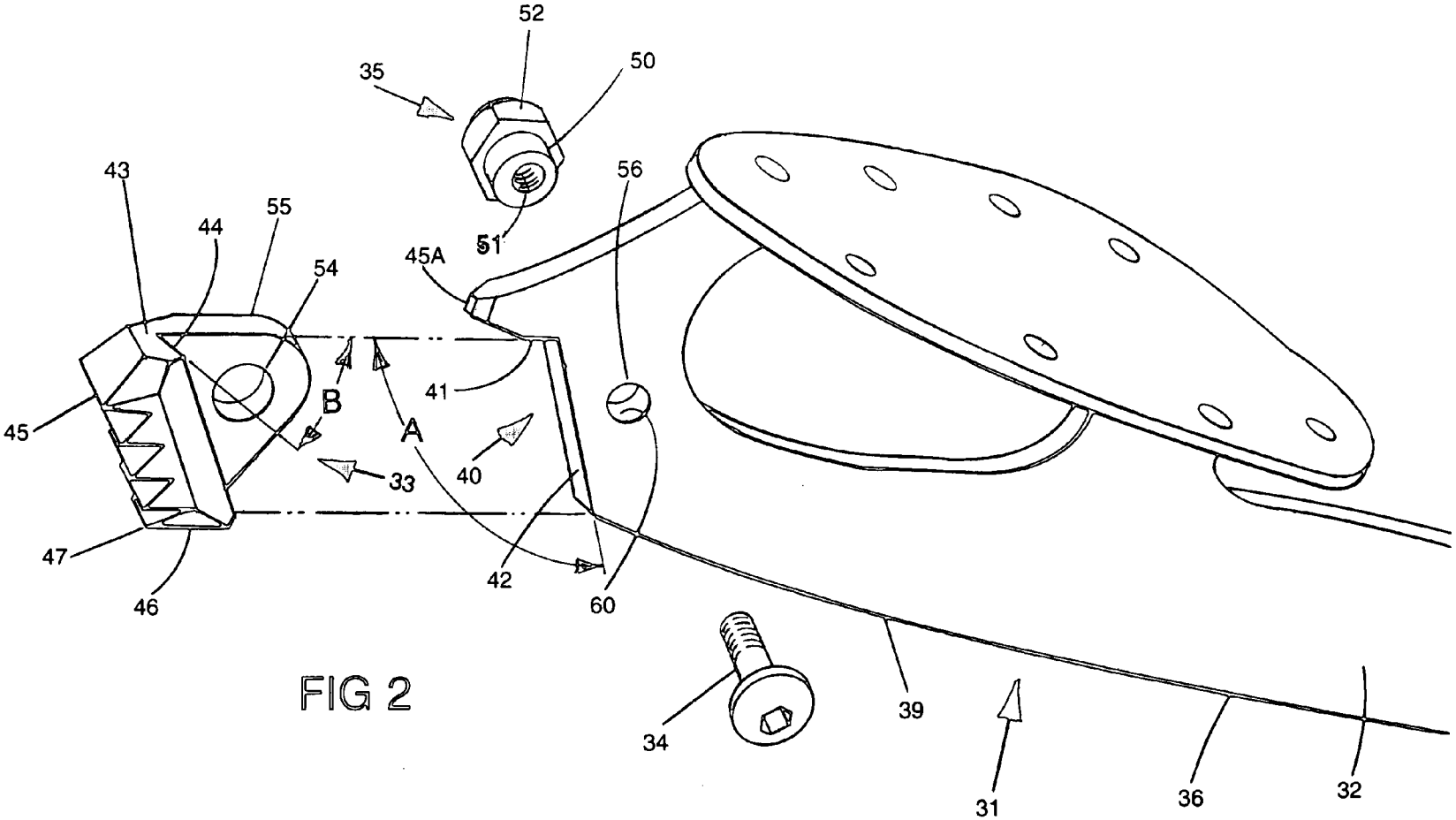
FIG. 2 is an exploded view of the assembly illustrated in FIG. 1.

The exploded perspective view of FIG. 2 shows the same components disassembled. Bolt 34 revealed as a button headed socket screw and cam locking member 35, invisible in FIG. 1, are shown dissembled.

Defining Structural Details Common to All Embodiments

The lengthwise rockered skating surface 36 that forms the lower perimeter of a skate structure or skate blade.

The groove 37 incorporated in this skating surface 36. It is best depicted in the section of FIG. 7.

The critical sharp edges 38 created by the groove 37, essential for controlled skating. These edges are best identified in FIGS. 7. The selection of location 39 in FIG. 3 for section 7-7 was purposely selected, emphasizing the rearward terminus of the NSZ All appropriate figures will include identification of the features, 36, 37 and 39 but textual descriptions of the embodiments won't be burdened with them.

In some embodiments the invention is applied to the complete skate wherein the blade is normally integral, this we are terming the structure 32. In others it is confined merely to the blade with skate structure shown in phantom. These phantom structures have not been given a reference number since they do not constitute part of the invention. In other embodiments where it does, this structure is directly referred to as a blade holder carrying an alphabetic suffix, viz. 32*a*, 32*b* and 32*c*.

FIRST PREFERRED EMBODIMENT

Single Flanged Toe-Pick Element Applied to a Figure Skate, Assemblies 31 and 31*a* Characterized by dual V indexing and registration of Toe-pick Element The perspective views of FIGS. 1 and 2 pertain to a free-style skate as described above with its toe-pick element 33 providing all but one of the required teeth. The orthogonal drawings of FIGS. 3 through 6 show an ice-dance skate for which an almost identical toe-pick element 33*a* is an appropriate size. It is then said to be a full compliment toe-pick element. Its difference is that for a dance skate the tip 47*a* of its drag tooth 46*a* is rounded.

FIG. 3 defines to scale: the ice skate assembly 31*a* comprising a lengthwise structure 32*a*, an attachable-detachable toe-pick element 33*a* shown assembled to the front of this structure, a fastening member 34 actually a commercial bolt in this embodiment and cam-locking member 35. It is not to be construed that structure 32*a* exclusively represents the traditional structure 32 shown in FIGS. 1 and 2 with integral skating surface 36 and as shown sectioned in FIG. 7. A blade strip h as shown in pre referenced U.S. Pat. No. 2,150,964 by H. Dornseif could be incorporated, or composite as claimed in U.S. Pat. No. 7,036,828 by Loveridge.

Traditional sole and heel plates are shown in phantom except they are shown planar and in co-planar alignment (a proprietary geometry being promoted by the applicant for manufacturing efficiency), used here to establish a horizontal datum into the drawing process and at the same time simplify this descriptive text.

In this and all following embodiments the toe-pick element 33 is shown installed with teeth 45 lying at a typical angle to the horizontal of 40°.

FIG. 4 defines the toe-pick element 33-disassembled, and FIG. 5 the V shaped dock 40 into which toe-pick element 33 installs. The dock, 40 is bounded by registration faces 41 and 42 that engage with indexing faces 43 and 44 on the toe-pick element 33*a* upon assembly. Face 42 is shown parallel to the angle of the teeth at 40° to the horizontal. That however is merely the most practical design option. Beveled faces 42 and 44 that constitute the second V are shown in intimate contact in FIGS. 6A, 6B and 6C. These dual V indexing provisions facilitate a wedge locking action that induces coercive forces in three mutually perpendicular axes by a singular force application, the camming action of the cam locking member 35.

Continuing to view FIG. 3, through 6, the toe-pick element 33 in this embodiment carries a full compliment of teeth 45 with the lowest tooth 46*a* termed the drag tooth typically protruding proud of a virtual extension of said rockered skating surface. In this embodiment the drag tooth 46*a* is shown with a rounded dance configuration requiring that an 'equivalent tip' 47*a* be uniquely identified in order to define the NSZ. The 'tip' location 47*a* on the drag tooth 46*a* is the point of contact made with a straightedge when it is laid against both the drag tooth 46*a* and the rockered skating surface 36. The NSZ structure 48 in this embodiment consists of the intermediate structure between the derived 'tip' location 47*a* on drag tooth 46*a* and location 39 on the skating surface 36. It comprises the underside 49*a* of drag tooth 46*a* as contiguous structure with the rockered skating surface 36 of structure 32 rearwardly to location 39, obviously with the toe-pick element 33 installed.

The cam-locking member 35 comprises a cam 50 that can be formed by providing an eccentrically located hole 51 within a circular perimeter. In the embodiment being described, the hole is threaded and a hexagon head 52 or other geometrical shape suitable for wrenching is provided. This head 52 overlaps the cam 50 to provide engagement face 53.

Fastening and locking of the toe-pick element 33*a* to the structure 32 necessitates accurate positioning of hole 54 located in the flange portion 55 of toe-pick element 33*a*, with respect to the indexing faces 43 and 44. Also hole 56 in structure 32*a* has also to be accurately sited with respect to registration faces 41 and 42. Such that, upon installation of the toe-pick element 33*a* into dock 40 with indexing faces 43 and 44 engaged with registration faces 41 and 42, the holes 53 and 54 are in the required juxtaposition to facilitate the locking action of cam 50 within hole 54. Installation of the cam locking member 35 in readiness for its camming function to be applied involves assembling its cam component 50 into hole 54, bolt 34 into hole 56 and fully threading it into the threaded hole 51 provided in the cam locking member. The cam 50 is then fully ensconced in hole 54 awaiting actuation. Hole 54 is slightly oversize to that of the cam 50 but hole 56 is a close bearing fit on the shank portion 34*d* of bolt 34. The depth of the cam 50 is shown to be somewhat less than the thickness of flange 55 enabling face 53 to engage the rear surface 55*a* of the flange 55 of the toe-pick element during the fastening and locking process. This is clearly shown in the sections of FIGS. 6A, 6B and 6C. However, as demonstrated in FIG. 6D this is not contributory to the fastening, indexing and locking mechanism. The clearance between cam 50 and hole 54 is shown exaggerated for clarity.

Referring to FIG. 6 threading of fastener 34 into cam locking member 35 proceeds as normal with threaded fasteners until its engagement face 53 tensions against rear face 57 of the toe-pick element 33. Because of the designed in clearance between cam 50 and hole 54, the normal procedure during fastening is to hold the registration and indexing faces 41, 42, 43, and 44 in contact with light finger pressure. At the same time the cam locking member 35 is rotated so as to engage its cam surface 58 with the inside wall 59 of hole 54.

Locking of this fastening method is now achieved by applying additional tightening torque to the cam locking member 35, the cam surface 58 of cam 50 camming against the inside wall 59 of hole 54. The camming force between the interface 58 and 54 is reacted through shank 34*d* of fastener 34 against the inner surface 60 of hole 56. The shear forces involved as a result of this adds to the effectiveness of the locking means but to resist these forces and the applied loads from skating maneuvers these components should preferably be heat-treated steel.

Figures 6A, 6B, 6C, 6D, 8:
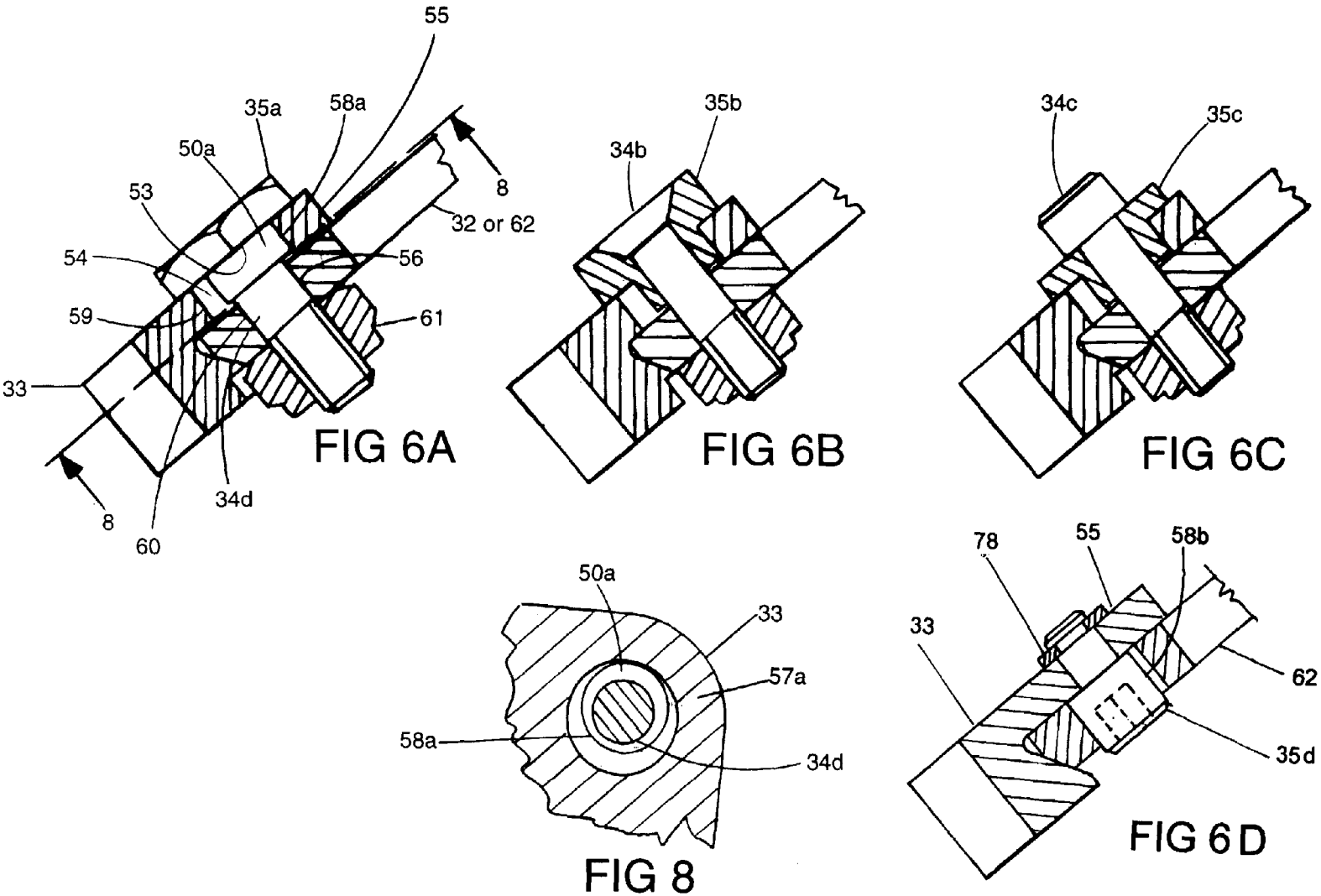
FIGS. 6A, 6B, 6C and 6D are alternatives to the arrangement of FIG. 6.
FIG. 8 is a section through the locking mechanisms shown in FIGS. 6, 6A, 6B and 6C

The important outcome of this meticulous positioning, fastening and locking procedure is to insure that the re-positioning of the tip 47 or 47*a* of the drag tooth 46 is replicated regardless of how often the toe-pick element 33*a* is disassembled and re-assembled. Basic to achieving this is the necessity for the applied angular direction of the previously mentioned camming force to be within the subtended angle formed by faces 41 and 42. This ensures that interface forces against faces 41 and 42 will result from the camming action. That they may not be uniform is inconsequential. This is achieved by slightly off-setting hole 54 in toe-pick element 33*a* with respect to hole 56 in structure 32*a* along an axis ideally angled parallel to a line bisecting the aforementioned subtended angle. However, the considerable extent of the subtended angle permits normal manufacturing tolerance levels for positioning of holes 46 and 56. The sectional view of FIG. 8 shows the cam fully cammed somewhat short of 'top dead center', a limit that manufacturing tolerances must accomplish. This sectional view is a projection from FIG. 6A discussed in detail in the next section, entitled Optional Fastening and Locking Mechanisms.

An additional security feature is embodied whenever a single flanged toe-pick element 33 or 33*a* is utilized, this results from the engagement of the complimentary bevels applied to faces 42 and 44 as shown in FIGS. 6, 6A, 6B and 6C. The previously mentioned camming force, through this engagement, applies a locking force perpendicular to the plane of its engagement. Locking is then achieved in three mutually perpendicular planes.

In regard to FIG. 7, the section shown signifies a flat traditional blade structure but as previously discussed this is merely pictorial. Primary purpose of the section is to clearly depict the essential skating surface 36 and edges 38.

Optional Fastening and Locking Mechanisms for Single Flanged Toe-Pick Elements

FIGS. 6A, 6B and 6C disclose alternate detail design approaches to the fastening and locking features of FIG. 6. They operate identically as described above and diagramed in the section of FIG. 8. Components differ as follows: In FIG. 6A the cam-locking member 35*a* has a male threaded extension with a plain shank section 57*a*acting as a bearing. During the locking process this plane shank section 57*a* engages the inside surface 60 of the hole 56. An ordinary nut 61, preferably of the locking type, tightens the threaded elements but does not contribute to the camming locking function of the cam locking member 35*a*. The alternatives designs of FIGS. 6B and 6C function identically, the cam locking member 35*b* merely using a through bolt 34b or 34c either, if preferred, being an interference fit into the former. For clarity, FIGS. 6B and 6C are used to identify the interfacing of faces 42 and 44. The index 42/44 is being used in this instance. Holes 54 and 56 constitute attachment provisions and threaded members 34 and 35, fastener means.

SECOND PREFERRED EMBODIMENT

Single Flanged Toe-Pick Element Applied to a Skate Blade, Assemblies 31*b* and 31*c*

FIGS. 9, 10 and 11 shows the invention adapted to the blade component 62 of a figure skate and for example the blade design of U.S. Pat. No. 7,036,828 has been selected. Its original integral toe-pick at the front of the blade 62 has been removed and modification 63 provided, accommodating: frontal tooth 45*a*, dock 40, index faces 41 and 42, hole 56, and re-positioned attachment screws holes 64 and 65. The blade holder, typical of the patent, that converts the blade into a complete skate, is shown in phantom in FIG. 9. Its frontal shape has also been revised to accommodate the intrusion of a toe-pick element 33 but since the holder is machined from an aluminum extrusion these are simple modifications.

The toe-pick element 33, dock 40 and free style tooth 45*a* replicate the detail geometry defined in FIGS. 1 and 2. Likewise, indexing and locking is identical as explained above and illustrated in FIG. 6 with options as shown in FIGS. 6A, 6B 6C and 6D.

This same method can be equally well applied when a figure skate blade is adapted to a hockey skate blade holder as illustrated in FIG. 12. The blade holder shown for this embodiment is an adaptation of the still very popular design presented in U.S. Pat. No. 4,074,909 by Balkie. The front 63*a* of the blade 62*a* has to be configured similarly to that shown in FIGS. 9 and 10 with the specific fastening recesses 66 identified in the patent. The blade holder, shown in phantom, is re-shaped to clear the toe-pick element 33. The latter, depicted in section in FIG. 13 is shown docked with the blade but void any fastening and locking mechanism. Any of the fastening and locking options of FIGS. 6B, 6*c*, and 6D is applicable.

FIG. 14 is a section of a double flanged version 33*b* of a toe-pick element. It is shown projected from FIG. 12 to emphasize interchangeability. It incorporates all essential docking features: registration faces 43 and 44 and hole 54 and is consequently interchangeable on any of the previous defined embodiments. It utilizes the fastening and locking mechanism of FIG. 16 which is explained in the next section.

THIRD PREFERRED EMBODIMENT

Double Flanged Toe-Pick Element Application, Assembly 31*d*

Figures 15, 16:
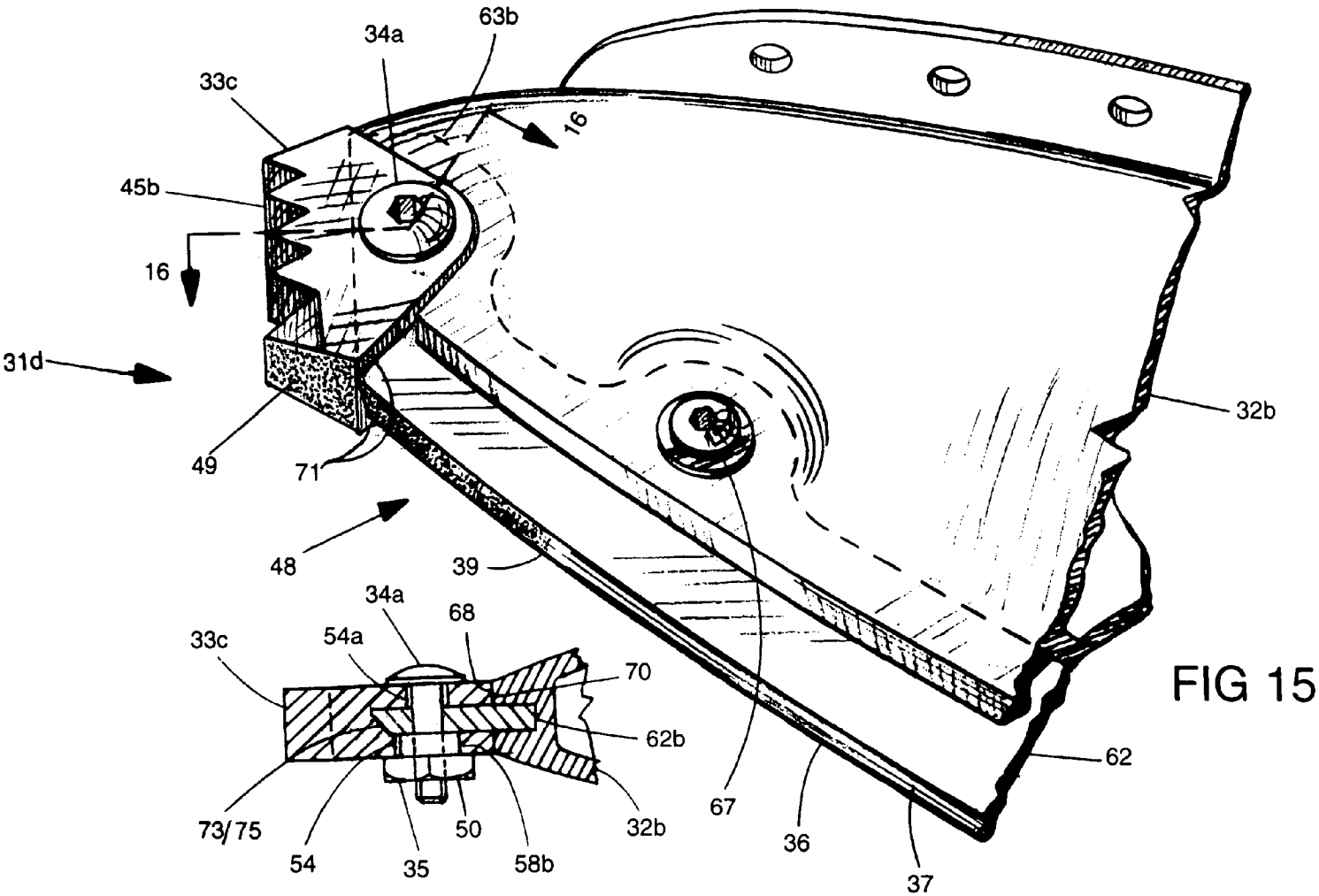
FIG. 15 is a perspective view of a double flanged toe-pick element adapted to a conventional hockey skate
FIG. 16 is a section through the fastening and locking mechanism of FIG. 15
Figures 17, 18:
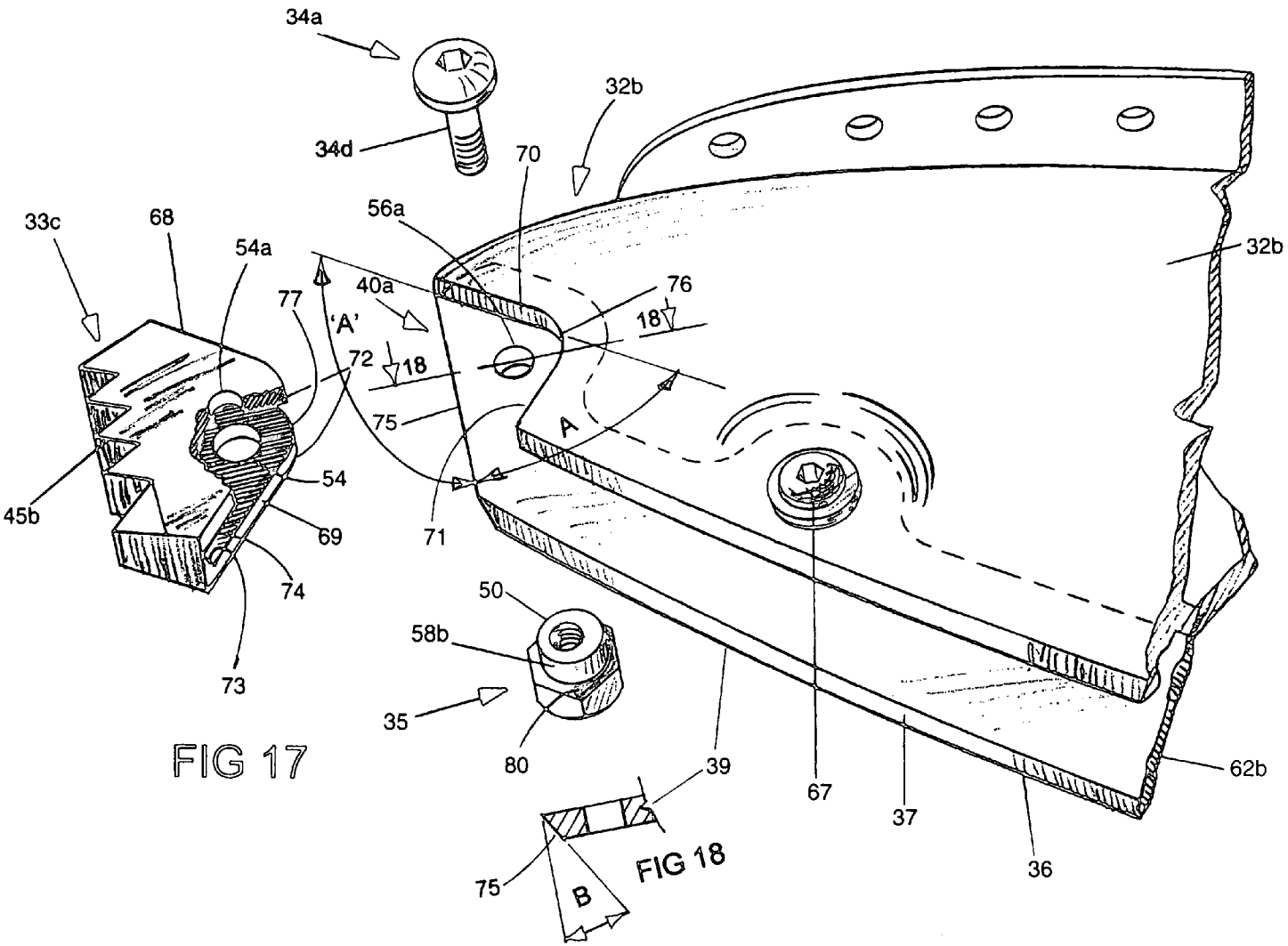
FIG. 17 is an exploded version of the figure skate assembly of FIG. 15
FIG. 18 is a riveted version of the construction of FIG. 15

FIGS. 15, 16 and 17 illustrated a skate assembly 31*d* adapting a figure skate blade 62*b* to a typical hockey blade holder 32*b* very similarly to the construction of FIG. 12 but using transverse screws 67 for attachment of blade 62*b* to holder 32*b*. Fundamental difference is that the dock 40*a* partially is formed in the blade holder 32*b*. It comprises registration face 70 in the blade holder and face 75 at the front of the blade form a much lesser included angle than the previous embodiments. However this is still very adequate to ensure that normal manufacturing tolerances on mating components will ensure that the camming force is shared by both pairs of interlocking faces, namely registration face 68 with indexing face 70 and registration face 73 with indexing face 75 leaving clearance between faces 69 and 71. Registration faces being on the toe-pick element 33*c* and the indexing faces in the holder 32*b*. The shaping of the dual flanges 72 of the toe-pick element 33*b*, as previously shown in FIG. 14, follow that of the single flange version 55 but that is merely a drafting convenience. Many other shapes would suffice. The re-configured hockey blade 62*b* involves modifications 63*b* at the front to accept the toe-pick element 33*c* as shown.

The fastening and locking mechanism utilizes the pre-described cam locking member 35 but with a fastener bolt 34*a* somewhat longer to accommodate the added flange 55*a*. It functions exactly as explained for the First Preferred Embodiment. Indexing faces 68 and 73 of the toe-pick element 33 engage registration faces 70 and 75 respectively as the cam 50 actuates in hole 54, the shank 34*d* of screw 34*a* reacting against the surface 60 of hole 56, best viewed in FIG. 6. The female indexing V in this embodiment takes a somewhat different form from that described previously. constituting surfaces 70 and 75, identified by the arc A in F*ig*. 17. The virtual V into which the force of the camming action needs to be directed is identified by arc 'A'. The secondary indexing V is identified B in the sectional view in FIG. 18.

The angled section line of FIG. 15 enables the projected section FIG. 16 to show the em-butted faces 68 and 70 in realistic contact.

The invention claimed is:

1. A figure skate kit offering the ability to sharpen the full length of its skating surface, the kit comprising:

(a) a flat longitudinal blade element with an integral, underlying skating surface which engages an ice surface in the execution of skating, the blade devoid of a traditional integral toe-pick, wherein a front side and a rear side of the blade comprise edges which form the skating surface (b) a dock formed at the front of the blade element which accommodates a detachable toe-pick element having dual indexing provisions for precise positional registration of said detachable toe-pick element (c) wherein the dual indexing provisions are provided by two edges of an angular indent at a forward end of the blade, the first of said edges being perpendicular to the plane of the blade, the second of said edges being obliquely oriented to the plane of the blade, wherein said two edges are formed contiguously with the rear side of the blade, thus forming three contiguous surfaces, said three contiguous surfaces forming two V indexes, one male and one female (d) wherein said detachable toe-pick element incorporates a complement of toe-pick teeth (e) wherein said detachable toe-pick element comprises two V indexes which are the exact counterpart to the two V indexes on the dock (f) a flange extending from the detachable toe-pick element parallel to the plane of the blade, and having an inner face which aligns with the rear side of the blade upon installation of the detachable toe-pick element into the dock (g) wherein the dual indexing provisions provide absolute positioning in three mutually perpendicular axes upon assembly of said detachable toe-pick and said blade element (h) a fastening provision which secures said detachable toe-pick and said blade element together (i) wherein said fastening provision is of a non-self-releasing variety (j) means for activating and de-activating said fastening provision.

2. The figure skate according to claim 1, wherein:

(a) the fastening provision comprises a non-self-releasing cam which acts and reacts against provisions in the blade and the detachable toe-pick element, and forcibly seats and locks the detachable toe pick element into the dual indexing provisions on the dock, the cam having a bearing extension enabling said acting and reacting (b) the flange comprises a hole which accommodates said bearing extension (c) the blade element comprises a hole adjacent said dock which accommodates said cam (d) the means for activating the fastening provisions comprises a wrenching provision attached to said cam.

3. The figure skate kit according to claim 2, wherein:

(a) axes of the two said holes are displaced, one with respect to the other, by the amount required by said cam and said bearing when said cam is activated by an enforced rotary motion, thus imparting a camming action against a wall of the hole provided in the detachable toe-pick element, and inducing the non-self-releasable locking force in said three mutually perpendicular axes.

4. The figure skate kit according to claim 3, wherein:

(a) the axes of the two said holes are displaced in a direction which is in the plane of the blade element and parallel to a line bisecting a subtended angle of said female V index in the blade element (b) the force resulting from said cam activation is distributed equally to said first edge, said second edge, and said rear side of the blade.

5. The figure skate kit according to claim 4, wherein: said detachable toe-pick element comprises less than a full complement of toe-pick teeth.

6. The figure skate kit according to claim 4, wherein:

(a) said detachable toe-pick element comprises a drag tooth forming, in conjunction with the skating surface, a non-skateable zone of a pre-selected extent.

7. The figure skate kit according to claim 5, wherein: said detachable toe-pick element comprises a drag tooth forming, in conjunction with skating surface, a non-skateable zone of a preselected extent.

8. An ice skate assembly offering the ability to sharpen the full length of its skating surface, the assembly comprising:

(a) a lengthwise structure comprising a blade holder portion and a planar figure skate blade, the blade devoid of a traditional toe-pick (b) said blade having a skating surface formed in a bottom edge, said blade terminating at a forward end in a dock formed in said structure for installation of a detachable toe-pick element, the front and rear sides of the blade forming the edges of the skating surface (c) said detachable toe-pick element incorporates a complement of toe-pick teeth (d) said dock comprising an indexing provision configured to provide positional indexing for the detachable toe-pick element in three mutually perpendicular axes (e) said detachable toe-pick comprising an indexing provision which is the exact counterpart to the indexing provision on said dock (f) a flange extending from the detachable toe-pick element parallel to the plane of the blade, and having an inner face which aligns with the rear side of the blade upon installation of the detachable toe-pick element into the dock (g) a fastening provision for securing the detachable toe-pick to said blade.

9. The ice skate assembly of claim 8, wherein:

(a) said indexing provision comprises three faces at the front of said structure, wherein the first face is the rear face of the blade, the other two faces are angularly oriented to the plane of the blade, the first of said other two faces is provided in said blade holder, normal to the plane of the blade, the second of said other two faces is oriented obliquely to the plane of the blade (b) said three faces form dual V indexes, female in the plane of the blade, and male oriented perpendicularly to the blade, said indexes providing precise installation of the detachable toe-pick element in the three mutually perpendicular axes (c) said fastening provision is of the non-self-releasing variety.

10. The figure skate according to claim 8, wherein:

(a) the non-self-releasing fastening provision comprises a cam which acts and reacts against provisions in the blade and detachable toe-pick element, and forcibly seats and locks the detachable toe pick element into said dual V indexing provisions on the dock.

11. The figure skate according to claim 10, wherein said provisions for accommodating the acting and reacting function of the cam element consist of:

i. a bearing extension provided on said cam and wrenching means for implementing its camming capability ii. holes in both the blade and the flange, one which accommodates said cam and the other which receives said bearing extension, the holes juxtaposed to direct the camming action of the cam into the female V index, forcibly locking the index provisions of the dock and the detachable toe-pick together, with said flange in forced contact with the read side of the blade when the cam is actuated.

12. The figure skate according to claim 11, wherein:

(a) the axes of the two said holes are displaced, one with respect to the other, by the amount required by said cam and said bearing to develop said non-self-releasing camming action against a wall of said hole in the detachable toe-pick element, thus locking the toe-pick element into the dock (b) said cam is actuated by an application of torque at said wrenching means.

13. The figure skate according to claim 12, wherein:

said detachable toe-pick element comprises a drag tooth forming, in conjunction with the skating surface, a non-skateable zone of a pre-selected extent.

* * * * *